US006880505B2

(12) United States Patent
Kinugawa et al.

(10) Patent No.: US 6,880,505 B2
(45) Date of Patent: Apr. 19, 2005

(54) VALVE TIMING CONTROL SYSTEM

(75) Inventors: Hiroyuki Kinugawa, Tokyo (JP); Akira Sakata, Tokyo (JP); Makoto Yamauchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/848,362

(22) Filed: May 19, 2004

(65) Prior Publication Data

US 2005/0005887 A1 Jan. 13, 2005

(30) Foreign Application Priority Data

May 21, 2003 (JP) ..... 2003-143752

(51) Int. Cl.[7] ..... F01L 1/34

(52) U.S. Cl. ..... 123/90.17; 123/90.15; 123/90.16; 123/90.31; 464/160; 464/161; 92/5 L

(58) Field of Search ..... 123/90.17; 92/5 L

(56) References Cited

U.S. PATENT DOCUMENTS 5,941,202 A * 8/1999 Jung ..... 123/90.17
6,311,658 B1 * 11/2001 Eguchi ..... 123/90.17
6,722,329 B1 * 4/2004 Pierik et al. ..... 123/90.17

FOREIGN PATENT DOCUMENTS

JP 2001-227308 A 8/2001

* cited by examiner

*Primary Examiner*—Kyle M. Riddle
(74) *Attorney, Agent, or Firm*—Sughrue Mion, PLLC

(57) ABSTRACT

Due to the fact that a regulator engages with an engagement aperture when hydraulic pressure is low due to unexpected decreases in engine rotation frequency during relative turning of a valve timing control device, the valve timing control device re-enters a regulated state.

Control and running of regulation or release of relative rotation position of the valve timing control device by a regulator are performed by an external device distinct from the valve timing control device.

16 Claims, 3 Drawing Sheets

VALVE TIMING CONTROL SYSTEM

BACKGROUND OF THE INVENTION

1. Field of the Invention

The present invention relates to valve timing control systems that use a valve timing control device for controlling open-close timing of either one or both of an inlet valve and an exhaust valve in an internal combustion engine, and in particular, a valve timing control device (later described as intermediate position regulation valve timing control device) where regulation of relative turning is necessary at an approximately intermediate position within the controllable range when the internal combustion engine starts to run.

2. Description of the Related Art

In conventional valve timing control systems, a stopper pin for regulating housing and vanes is arranged in a valve timing control device, release of the stopper-pin is controlled by hydraulic pressure introduced into the valve timing control device, into advance-angle and retard-angle hydraulic pressure chambers, and the stopper pin release is controlled by using hydraulic pressure in an independent dedicated oil channel, distinct from the hydraulic pressure for controlling the relative turning position of the valve timing control device (for example, see Japanese Laid-Open Patent Publication 2001-227308, pages 6–7, FIG. 6).

A dedicated oil channel and a hydraulic control valve are provided in conventional valve timing control system in order to control regulation/release of relative turning of a valve timing control device by a regulator, however, because hydraulic pressure in an engine is generated by the engine's rotational output, for a certain period after the engine starts running, the hydraulic pressure is not supplied to the valve timing control device and the release of the regulator cannot be controlled.

Furthermore, during the normal running of the engine, the hydraulic pressure is applied steadily to the regulator via the hydraulic control valve and the dedicated oil channel, so that losses occur at hydraulic pressure input to these members while the engine is running, and due to oil leaks from various members.

Additionally, because the regulator engages with an engagement aperture when the hydraulic pressure becomes low due to unexpected decreases in engine rotation frequency during relative turning of the valve timing control device, the valve timing control device re-enters a regulated state.

Further, because cutting operations are required in order to install the dedicated oil channel and the hydraulic pressure control valve in the engine, and because a cleaning step in manufacturing this hydraulic system is necessary, the manufacturing process is complicated.

SUMMARY OF THE INVENTION

The present invention is directed at solving these problems, and has as an object the realization of a valve timing control system in which the release of the regulator can be controlled even after the engine has started to run.

A further object is the realization of a valve timing control system in which the hydraulic pressure is applied steadily to the regulator, and hydraulic pressure losses do not occur due to oil leaks from the dedicated hydraulic oil pressure channel.

Another object is the realization of a valve timing control system in which inadvertent regulation by the regulator due to a decrease in the hydraulic pressure due to lower rotation frequency of the engine does not occur.

An additional object is the realization of a valve timing control system in which, by providing dedicated hydraulic pressure channels, cutting and machining processes and cleaning processes after the machining are unnecessary.

In the valve timing control system related to the present invention, regulation or release of the relative turning position of the valve timing control device by the regulator is done by an external device distinct from the valve timing control device.

DESCRIPTION OF THE PREFERRED EMBODIMENT

Embodiment 1

An embodiment of the present invention is explained as follows.

Figure 1:
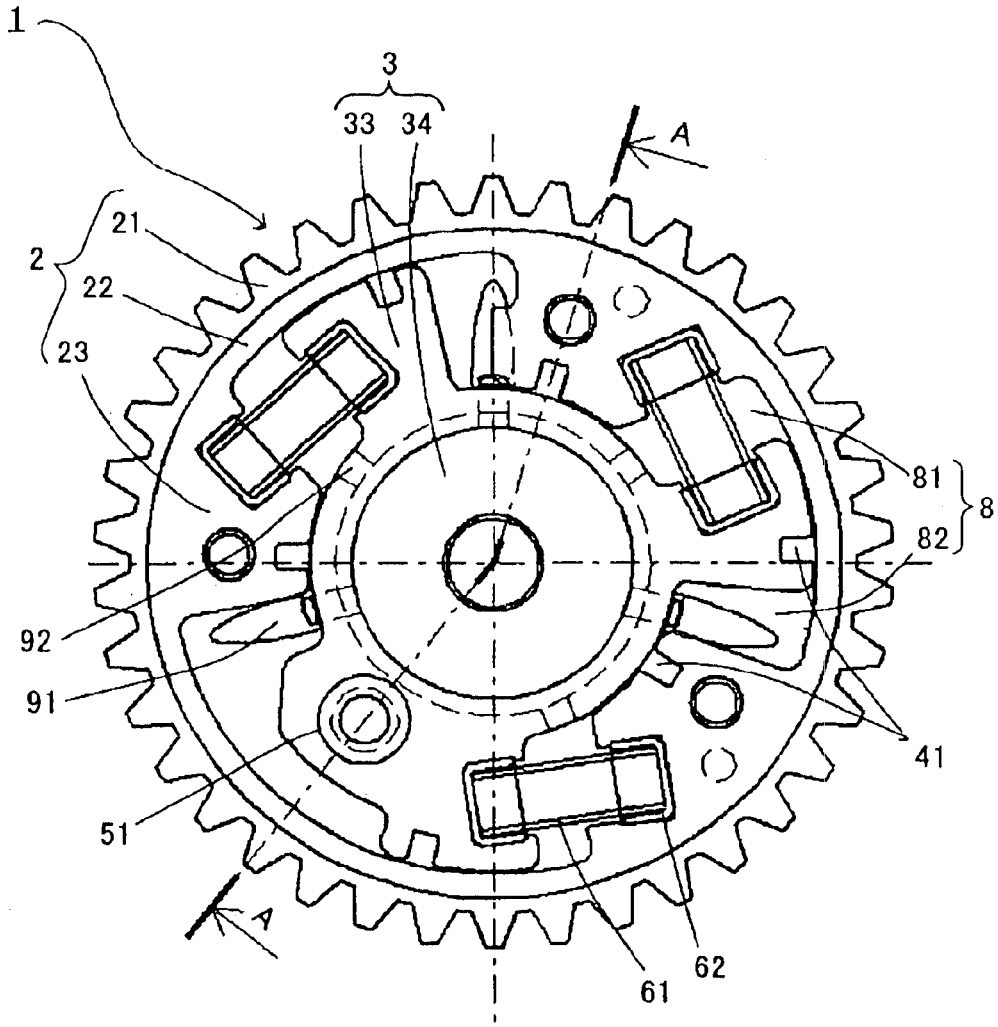
FIG. 1 is a radial sectional view of a valve timing control device according to Embodiment 1 of the present invention.
Figure 2:
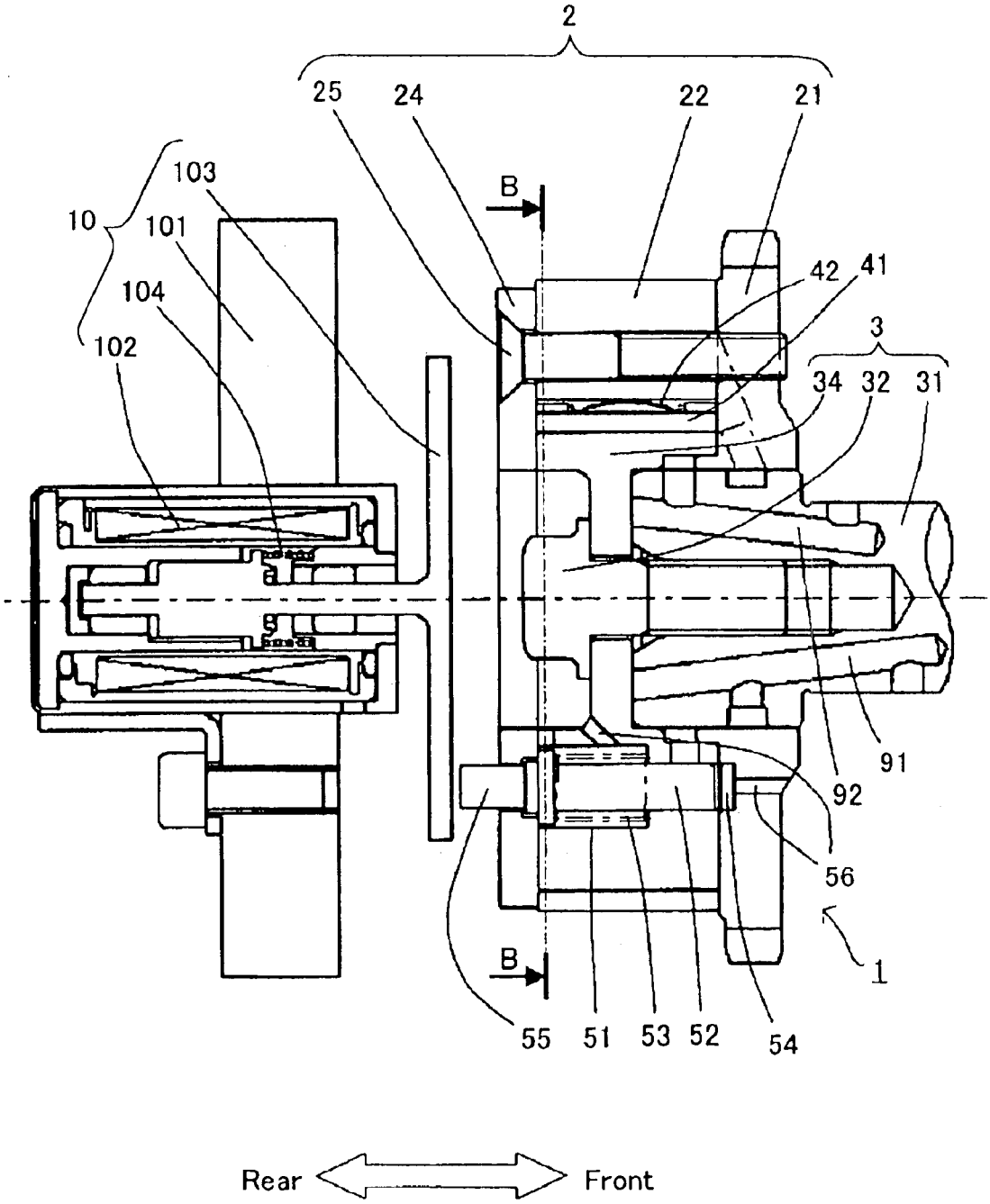
FIG. 2 is an axial sectional view of the valve timing system according to Embodiment 1 of the present invention, and illustrates a regulation release state.
Figure 3:
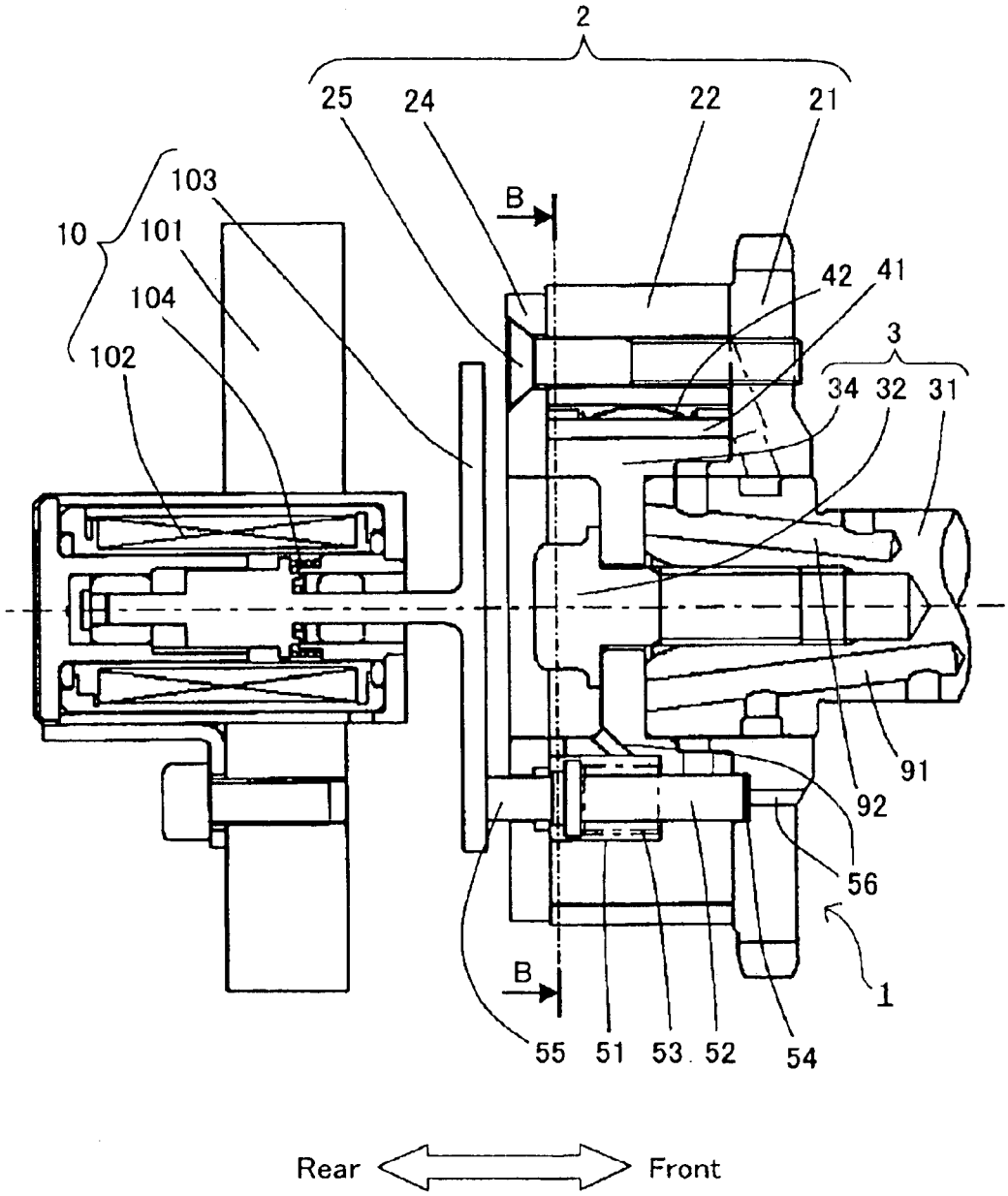
FIG. 3 is an axial sectional view of the valve timing system according to Embodiment 1 of the present invention, and illustrates a regulated state.

With regard to a valve timing control device 1 for controlling the open-close timing of inlet/exhaust valves of an internal combustion engine, FIG. 1 illustrates a radial section view (B—B section in FIG. 2) of Embodiment 1 of the present invention, FIG. 2 illustrates an unregulated state at the A—A section in FIG. 1, and FIG. 3 illustrates a regulated state. For convenience, in the explanation, the left hand side of FIG. 2 is taken as the rear and the right hand side as the front.

A valve timing control device 1 of the Embodiment comprises: a sprocket 21, connected to a chain (not illustrated) and a crankshaft (not illustrated), which is an output shaft of the internal combustion engine, and rotating together with the crankshaft, a case 22 comprising, on its inner side, a plurality of shoes 23 with a protruding shape and hydraulic pressure chambers 8 between the shoes 23, a housing 2 integrated, through fasteners 25, with a cover 24 that closes the hydraulic pressure chambers 8, and a rotor unit 3 comprising a rotor 34 integrally fixed, through a second fastener 32, to a camshaft 31, and having a plurality of vanes 33 that divides the hydraulic pressure chambers 8 formed between the shoes 23 into advance-angle hydraulic pressure chambers 81 and retard-angle hydraulic pressure chambers 82.

Furthermore, seals 41 to prevent oil leakage from between the advance-angle hydraulic pressure chamber 81 and the retard-angle hydraulic pressure chamber 82, leaf springs 42 that urge the seals 41 in a radial direction, a first oil channel 91 for supplying and releasing hydraulic pressure to the advance-angle hydraulic pressure chamber 81, and a second oil channel 92 for supplying and releasing hydraulic pressure to the retard-angle hydraulic pressure chamber 82 are also provided.

A control valve (not illustrated), for controlling a supply of hydraulic pressure from an engine oil pump (not illustrated) to the first oil channel 91 and the second oil channel 92, is arranged between the engine oil pump and the oil channels.

A housing aperture 51 provided in the vanes 33 of the rotor unit 3, a locking pin 52 that can slide inside the housing aperture 51, a first biasing member 53, housed inside the housing aperture 51, that urges the locking pin 52 in the release direction (rear direction), an engaging aperture 54, provided in the housing 2, to which the locking pin 52 engages when the relative turning positions of the housing 2 and the rotor unit 3 are in predetermined positions (hereinafter referred to as an initial position), a connecting member 55, disposed between an external device 10 and the locking pin 52 and mounted slideably inside the cover 24, second biasing members 61, arranged inside the advance-angle hydraulic pressure chamber 81, that urge the rotor unit 3 in an advance-angle direction, holders 62 that prevent interference between the second biasing members 61 and similar members, and that can fit the shoes 23 of the housing 2 into the concave parts of the vanes 33 of the rotor unit 3 in order to facilitate assembly of the biasing member are provided.

The external device 10, distinct from the valve timing control device 1, in a casing 101 on the rear of the internal combustion engine facing the valve timing control device 1, installed coaxially to the valve timing control device 1, comprises: a coil 102 that generates magnetic force, when energized, for moving a core member 103 in a forward direction, a core member 103 that can slide relative to the coil 102 and is in contact with a contact portion 55 of the valve timing control device 1, and a third biasing member 104 that urges in a backward direction the core member 103 when not energized.

The engaging of the locking pin 52 will now be explained.

When the engine is started in a state with the locking pin 52 disengaged from the engaging aperture 54, the coil 102 of the external device 10 is energized, and by generating magnetic force larger than the third biasing member 104, the core member 103 is pushed outwards in a forward direction and touches the contact portion 55, and, through the contact portion 55, the locking pin 52 is pushed in a forward direction against the first biasing member 53.

At this time, if the relative turning position of the valve timing control device 1 is in the initial position, the advanced edge of the locking pin 52 can engage with the engaging aperture 54. Further, apart from the initial position, when the relative turning position of the valve timing control device 1 has passed the initial position due to the alternating reaction forces of the valve at cranking time and backlash from the urging power of the second biasing member 61, the advanced edge of the locking pin 52 can engage with the engaging aperture 54.

The engagement of the locking pin 52, while the engine is running, moves and holds the relative turning position of the housing 2 and the rotor unit 3 at the initial position, by means of the hydraulic pressure of the advance-angle and the retard-angle. Next, the coil 102 of the external device 10 is energized, and by generating magnetic force larger than the third biasing member 104, the core member 103 is pushed outwards in a forward direction and touches the contact portion 55, through the contact portion 55, the locking pin 52 is pushed in a forward direction against the first biasing member 53, and the advance edge of the locking pin 52 can engage with the engaging aperture 54.

In this way, the engine can be halted while the locking pin 52 is engaged, and after the engine has halted, through the valve reactive forces or the urging of the second biasing member 61, the locking pin 52 seizes the matching side face of the engaging aperture 54, the locking pin 52 is held in the engaged state, and the engine can be stably started next time.

Even if it should happen that when the engine is being stopped it comes to a halt with the locking pin 52 pulled out, because the valve timing control device 1 stops close to the relative-turning regulated position, the next time the engine is started the locking pin 52 can engage easily and the internal combustion engine can be started stably.

Next, a method of releasing the locking pin 52 is explained.

When the engine is started and the valve timing control device 1 enters a state where control of the hydraulic pressure is possible, the locking pin 52 is released, however, in order that the locking pin 52 does not seize the side face of the engaging aperture 54 at this time, supply/release of hydraulic pressure is halted for the advance-angle hydraulic pressure chamber 81 and the retard-angle hydraulic pressure chamber 82 of the valve timing control device 1.

This means that, when the locking pin 52 is in the engaged state, there is a hydraulic pressure differential in the advance-angle or the retard-angle of the valve timing control device 1, and when the valve timing control device 1 is in a state where relative turning is possible, the side face of the locking pin 52 seizes the side face of the engaging aperture 54, and the release of the locking pin 52 by the urging of the third biasing member 104 becomes impossible.

Further, in the state where the supply/release of hydraulic pressure inside the advance-angle hydraulic pressure chamber 81 and the retard-angle hydraulic pressure chamber 82 of the valve timing control device 1 is halted, if the coil 102 of the external device 10 is put in a non-energized state, the magnetic force of the coil 102 disappears, and the core member 103 is pushed down in a backwards direction by the urging force of the third biasing member 104, and is separated from the contact member 55.

Because the urging force of the external device 10 on contact portion 55 is gone, by the urging force of the first biasing member 53 and the locking pin 52, the locking pin 52 is moved in a backward direction, and by the edge of the locking pin 52 separating from the engaging aperture 54, the regulation of the relative turning of the locking pin 52 is relaxed.

The housing aperture 51 and the engaging aperture 54 each have air communicating paths 56, and by sliding clearance, hydraulic pressure that has leaked into both apertures can be discharged.

In this way, there is no external disturbance from the hydraulic pressure, and control of the engagement/release of the locking pin 52 is possible with only the urging of the first biasing member 53 and the third biasing member 104, and the magnetic force generated in the coil 102.

When the engine is running normally, the rotor is urged to move in the direction of the retard-angle due to the open/close driving of the inlet/exhaust valve by the camshaft 31, however, even if the hydraulic pressure drops when the engine is idling, due to the urging of the second biasing member 61, it is possible to hold the position of the rotor unit 3 at a desired relative turning position including the initial position.

As the external device 10 in this embodiment, the locking pin is controlled using an electromagnetic solenoid, however, alternative effective methods include converting the motor rotation direction to the shaft orientation by a motor and a lead screw, or converting the motor rotation direction to the shaft orientation by a worm gear.

In this embodiment a single locking pin 52 is used, however, by using a plurality of pins at approximately symmetric angles to the center shaft of the valve timing control device 1, the regulator can perform regulation without the external device 10 giving any load bias to the valve timing control device 1.

In this embodiment, by the valve timing control device energizing the external device only when the locking pin is necessary and only when the engine stops and starts running, engaging and releasing of the locking pin can be controlled, and by stopping the energizing while the engine is running normally, additional power consumption and hydraulic pressure losses in the engine can be avoided, and the locking pin can be effectively kept in a released state.

Further, the engagement/release of the locking pin can be controlled even when there is no hydraulic pressure or when it is low, as when the engine is stopped or when it is being started up, so that it is possible to stably maintain the valve timing control device position.

Because controlling the engagement/release of the locking pin is performed without using hydraulic pressure, dedicated oil channels are not required, and machining operations can be reduced.

In this embodiment, since the stopper pin of the valve timing control device rotating in synchronization with the camshaft and crankshaft is driven by the external device provided outside the valve timing control device, a structure need not be provided to drive the stopper pin, inside the valve timing control device, thus, the valve timing control device can be simplified, the weight of the valve timing control device that acts on the camshaft can be reduced, and camshaft eccentricity can be minimized. In addition, by providing a drive structure to drive the stopper pin in the valve timing control device, it is not necessary to provide the oil channels or electric power supply channels or similar, for driving the stopper pin, on the contact faces of the valve timing device and bearings, or the camshaft and bearings, or on each of the contact faces of the camshaft and the valve timing control device, and minimization of contact faces can be realized. In this way, improvements in space efficiency and reductions in sliding losses through reductions in sliding surfaces can be realized.

In this embodiment, drive power is generated by an electrical solenoid provided in the external device to drive the stopper pin, however, the stopper pin may also be driven by other means such as a hydraulic pressure drive or a motor drive.

As a stopper pin, a pin that moves in an axial direction is used, however, a stopper pin that moves in a radial direction may also be used. In this case, the external device may be arranged to drive the stopper pin from a radial direction. The contact member protruding on the outer circumference of the valve timing control device may be driven by, for example, the core member divided into three portions and driven by three solenoids.

The stopping pin is illustrated as being provided inside the vanes, however, it may also be provided, for example, inside the shoes, and furthermore, it may also be provided in the rotor of the rotor unit (that is, the shaft center portion).

The valve timing control system related to the present invention enables control of engagement and release of a regulating means even when there is no hydraulic pressure or when it is low, where the engine is stopped or where it is being started up, so that the position of the valve timing control device can be stably maintained.

What is claimed is:

1. A valve timing control system comprising a valve timing control device including:

a first rotor unit connected to an output shaft of an internal combustion engine, rotating together with the output shaft, having a plurality of inner-side protrusions that forms hydraulic pressure chambers between the protrusions;

a second rotor unit having a plurality of vanes that divides each of the protrusion hydraulic chambers into an advance-angle hydraulic pressure chamber and a retard-angle hydraulic pressure chamber, inserted into the first rotor unit so as to be moveable through a given angle, and fixed integrally to a drive shaft for driving at least one of an inlet valve or an exhaust valve of the internal combustion engine;

a regulator member, housed slideably in one of either the first or the second rotor unit, for regulating the relative turning of the first rotor unit and the second rotor unit by engaging-aperture engagement;

an engaging aperture, provided in the other of either the first or the second rotor unit, for engaging with the regulator when the first rotor unit is in a given position relative to the second rotor unit; wherein regulation or release of the relative turning position of the valve timing control device by the regulator is controlled by an external device distinct from the valve timing control device.

2. The valve timing control system as set forth in claim 1, wherein the external device is installed coaxially with the valve timing control device, in the internal combustion engine casing.

3. The valve timing control system as set forth in claim 1, wherein the external device is an electrically powered device.

4. The valve timing control system as set forth in claim 3, wherein the external device is installed coaxially with the valve timing control device, in the internal combustion engine casing.

5. The valve timing control system as set forth in claim 3, wherein the regulator can be connected to the external device.

6. The valve timing control system as set forth in claim 5, wherein the external device is installed coaxially with the valve timing control device, in the internal combustion engine casing.

7. The valve timing control system as set forth in claim 5, wherein, for abutment between the external device and the regulator, a plurality of faces at angles approximately symmetrical with respect to the central shaft of the valve timing control device is used.

8. The valve timing control system as set forth in claim 7, wherein the external device is installed coaxially with the valve timing control device, in the internal combustion engine casing.

9. The valve timing control system as set forth in claim 3, wherein the external device has a member that can slide relative to the axial direction of the valve timing control device.

10. The valve timing control system as set forth in claim 9, wherein the external device is installed coaxially with the valve timing control device, in the internal combustion engine casing.

11. The valve timing control system as set forth in claim 1, wherein the regulator can be connected to the external device.

12. The valve timing control system as set forth in claim 11, wherein the external device is installed coaxially with the valve timing control device, in the internal combustion engine casing.

13. The valve timing control system as set forth in claim 11, wherein, for abutment between the external device and the regulator, a plurality of faces at angles approximately symmetrical with respect to the central shaft of the valve timing control device is used.

14. The valve timing control system as set forth in claim 13, wherein the external device is installed coaxially with the valve timing control device, in the internal combustion engine casing.

15. The valve timing control system as set forth in claim 1, wherein the external device has a member that can slide relative to the axial direction of the valve timing control device.

16. The valve timing control system as set forth in claim 15, wherein the external device is installed coaxially with the valve timing control device, in the internal combustion engine casing.

* * * * *